US009536652B2

(12) United States Patent
Chen et al.

(10) Patent No.: US 9,536,652 B2
(45) Date of Patent: Jan. 3, 2017

(54) INDUCTOR

(71) Applicant: U. D. ELECTRONIC CORP., Taoyuan (TW)

(72) Inventors: Ming-Tzu Chen, Taoyuan (TW); Yu-Chin Hsu, Taoyuan (TW)

(73) Assignee: U. D. ELECTRONIC CORP. (TW)

( * ) Notice: Subject to any disclaimer, the term of this patent is extended or adjusted under 35 U.S.C. 154(b) by 0 days.

(21) Appl. No.: 14/862,153

(22) Filed: Sep. 23, 2015

(65) Prior Publication Data

US 2016/0099101 A1 Apr. 7, 2016

(30) Foreign Application Priority Data

Oct. 3, 2014 (TW) ..... 103134584 A

(51) Int. Cl.
*H01F 27/29* (2006.01)
*H01F 27/02* (2006.01)
*H01F 27/28* (2006.01)

(52) U.S. Cl.
CPC ..... *H01F 27/2823* (2013.01); *H01F 27/02* (2013.01); *H01F 27/29* (2013.01)

(58) Field of Classification Search
None
See application file for complete search history.

(56) References Cited

U.S. PATENT DOCUMENTS 6,472,969 B1 * 10/2002 Hanato ..... H01F 17/045 336/192
8,093,980 B2 * 1/2012 Asou ..... H01F 17/045 336/192
2008/0036566 A1 * 2/2008 Klesyk ..... H01F 27/027 336/84 M
2010/0109827 A1 * 5/2010 Asou ..... H01F 17/045 336/192

OTHER PUBLICATIONS

English translation of JP2008186996.*

* cited by examiner

*Primary Examiner* — Elvin G Enad
*Assistant Examiner* — Ronald Hinson

(57) ABSTRACT

The present invention relates to an inductor, wherein the inductor according to the present invention includes: a body, a winding wire winded around the body, and a housing used for covering the body, according to the present invention, the inductor reduces the volume and increases the withstanding voltage of inductor by twisting the wires, and the present invention also provide a production method of the inductor can simplify the production process of inductors.

5 Claims, 15 Drawing Sheets

1

1

1

INDUCTOR

BACKGROUND OF THE INVENTION

1. Field of the Invention

The present invention relates to the structure and the manufacture of an inductor, and more particularly, to an improvement of an inductor.

2. Description of the Prior Art

Nowadays, with the development of electronic component, inductors are widely applied in the circuit of communication system, signal processing system, electrical filter, tank circuit, etc. Besides, as times change, size of the electronic components must be scaled down due to the volume reduction of electronic systems, wherein engineers are dedicated in reducing the size and the withstanding voltage of the inductors so as to eliminate the chances of arc generation.

Inductor is a passive component in electronic circuit and consisted of ferrite core and coil. In order to comply with different kinds of electronic circuits, there are various forms of inductors are developed. Moreover different forms of inductors usually have different inductance properties; for example, the inductance property of a choke inductor is obviously different from a coil inductor.

Please refer to FIG. 1, there is shown a stereo view of a conventional inductor. As shown in FIG. 1, a conventional inductor comprises a winding portion P11 and two flange portions P12, wherein each the flange portion P12 has four wire accommodating portions P121. when manufacturing the conventional inductor, it needs to firstly wind four enameled wires P2 around the said winding portion P11, and then respectively disposing the two terminal ends of each enameled wires P2 on the wire accommodating portions P121.

Continuously referring to FIG. 1, and please simultaneously refer to FIG. 2, where a schematic assembly diagram of the conventional inductor and PCB board is illustrated. As shown in FIG. 1 and FIG. 2, the two wire accommodating portions P121 located in the middle must to be shorted based on the electronic component characteristics, such that the four wire accommodating portions P121 are respectively contacted to first conductive plate P31 and second conductive plate P32 of PCB board P3, so as to make the said four enameled wires P2 be pairwise shorted to each other.

However, in the process of manufacturing the conventional inductor, due to the said two flange portions P12 are respectively disposed on the both ends of the winding portion P11, the number of turns and the length of the enameled wires are directly limited to the length of the winding portion P11, in this case, the size of the winding portion P11 usually have to be bigger for increasing the inductance characteristics of inductor, thus, the size of inductor would be increased. Therefore, how to strike a balance between the inductance characteristic and the size of inductor often let manufacturers and designers into a dilemma.

Inheriting to above description, due to the structure of conventional inductor disposed four wire accommodating portions P121 for respectively accommodating the both sides of each of the enameled wires, then shorting the enameled wires via the second conductive plate P32 of the PCB board P3; however, during the PCB board P3 manufacturing process, the second conductive plate P32 must to be bigger for being contact with two of the wire accommodating portions P121 and bigger conductive plate would increase the manufacturing cost.

Accordingly, in view of the conventional inductor still have some shortcomings and drawbacks, the inventor of the present application has made great efforts to make inventive research thereon and eventually provided an inductor.

SUMMARY OF THE INVENTION

The primary objective of the present invention is to provide an inductor, which reduces the volume and increases the withstanding voltage of inductor by twisting the wires, and the present invention also provide a production method of the inductor can simplify the production process of inductors.

Accordingly, to achieve the above objectives of the present invention, the inventor proposes an inductor, comprising:

a body;

a winding wire, being winded around the body, wherein the winding wire comprises at least two primary-side wires and at least two secondary-side wires;

a housing, being used for covering the body;

wherein the body is formed with two primary-side welding protrusions, a primary-side center-tapped protrusion, two secondary-side welding protrusions, and a secondary-side center-tapped protrusion;

wherein one end of the at least two primary-side wires are respectively welded on the two primary-side welding protrusions, and the other end of the two primary-side wires being welded on the primary-side center-tapped protrusion;

wherein one end of the at least two secondary-side wires are respectively welded on the two secondary-side welding protrusions, and the other end of the two secondary-side wires are welded on the secondary-side center-tapped protrusion.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

Figure 1:
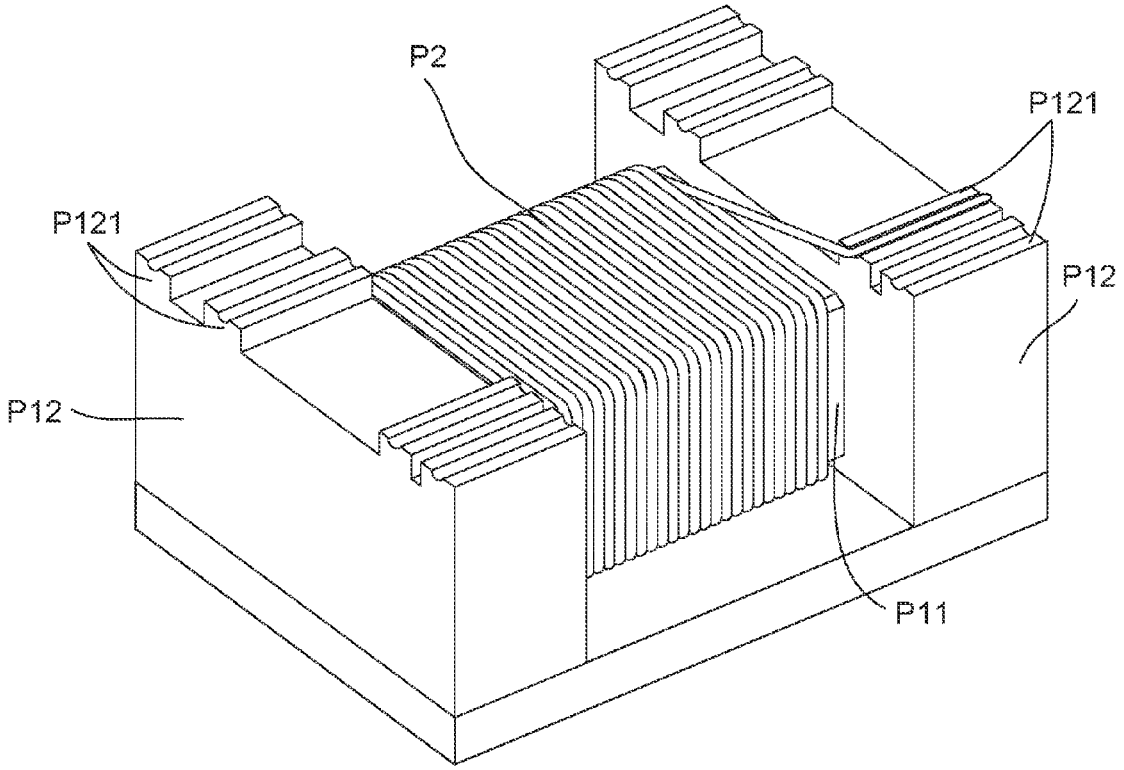
FIG. 1 (Prior Art)
FIG. 1 is a stereo view of a conventional inductor.
Figure 2:
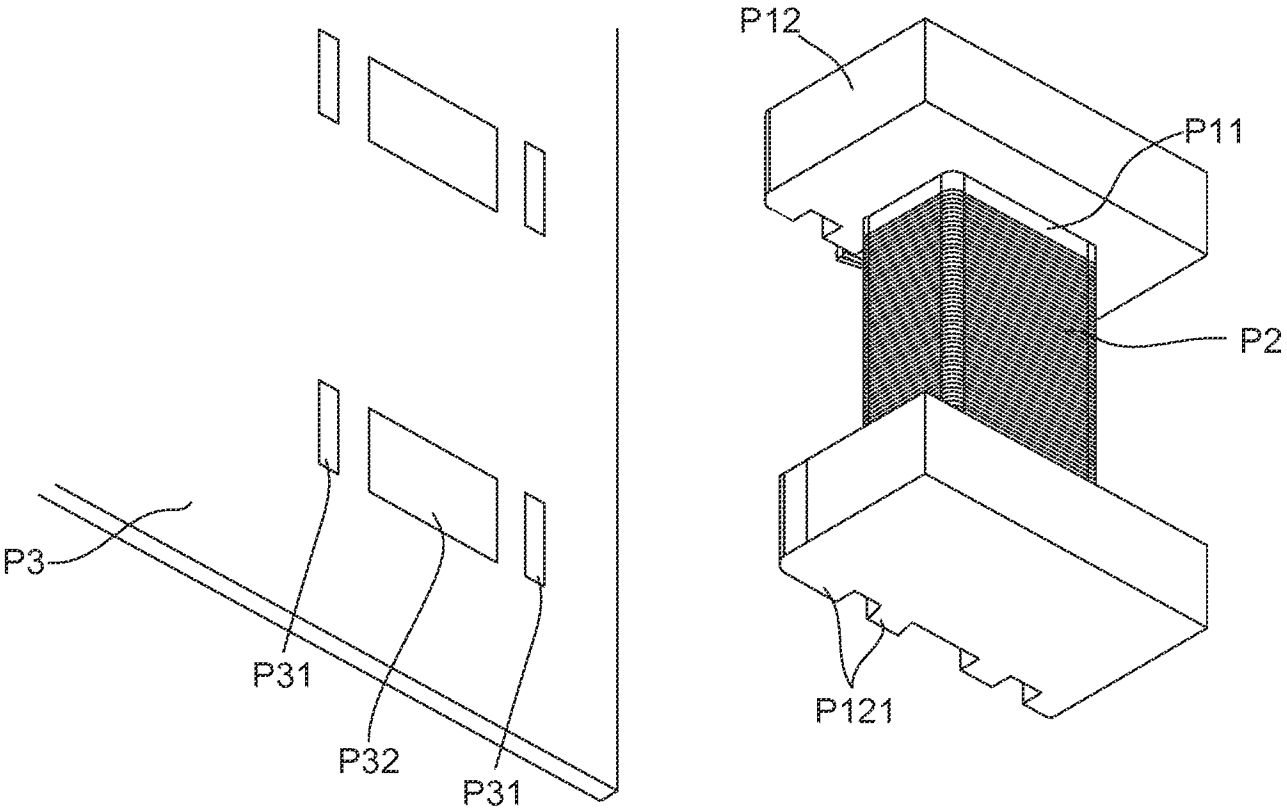
FIG. 2 (Prior Art)
FIG. 2 is a schematic assembly diagram of the conventional inductor and PCB board is illustrated.

To more clearly describe an inductor according to the present invention, embodiments of the present invention will be described in detail with reference to the attached drawings hereinafter.

With reference to FIG. 3, FIG. 4, FIG. 5, FIG. 6, and FIG. 7, there are respectively shown a stereo view of winding wire according to the present invention, a schematic assembly diagram of an inductor of the present invention, a second schematic assembly diagram of the inductor, a sectional side view of housing, and a schematic diagram of welding point. As shown in FIGs, an inductor 1 of the present invention consists of a body 12, a winding wire 11 winded around the body 12, and a housing 13 used for covering the body 12, wherein the body 12 and the housing 13 are made of a plastic doped with iron powder.

Moreover, the winding wire 11 comprises at least two primary-side wires (111, 112) and at least two secondary-side wires (113, 114), wherein the primary-side wires and the secondary-side wires are twisted together, and the said primary-side wires (111,112) and the said secondary-side wires (113,114) consist of a copper wire and an insulating layer enclosing the copper wire.

Furthermore, a recess 132 is formed in the inner bottom of the housing 13, wherein when the housing 13 covers the body 12, winding portion 121 of the body 12 is housed by the housing 13 and the lower end of the winding portion 121 is disposed in the recess 132.

Figure 3:
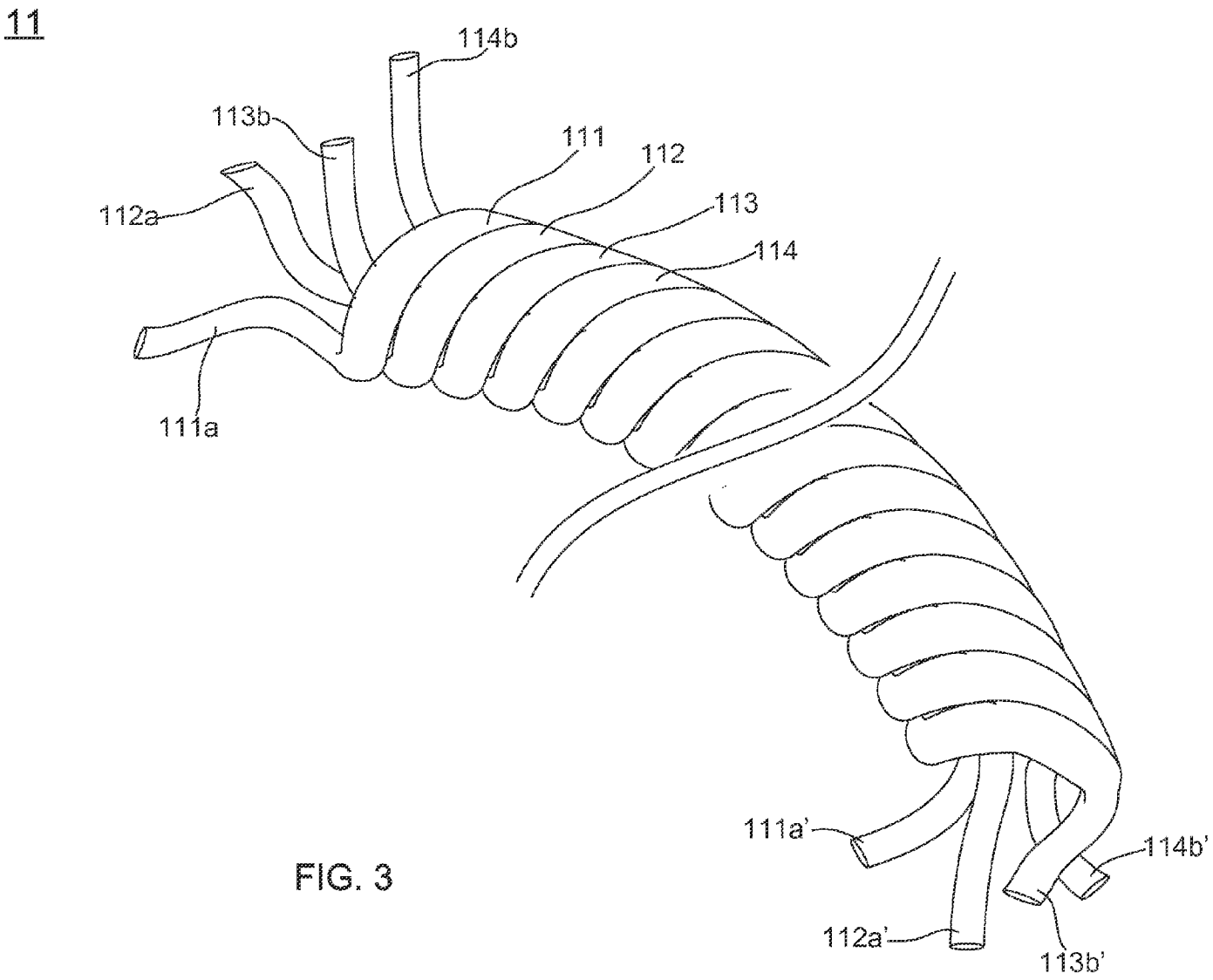
FIG. 3 is a stereo view of winding wire according to the present invention.

Besides, the said inductor 1 according to the present invention can be manufactured via the following steps: wire intertwined step, wire winded around step, and housing covering step. In more detail, as the FIG. 3 shown, the wire intertwined step is finished by intertwining at least two primary-side wires (111, 112) and at least two secondary-side wires (113, 114) together so as to make the winding wire 11, wherein the both terminal ends of the primary-side wires and the secondary-side wires (111*a*, 111*a*', 112*a*, 112*a*', 113*b*, 113*b*', 114*b*, 114*b*') are respectively located at both ends of the winding wire 11.

After finish the wire intertwined step, the manufacturing process implements the wire winded around step, winding the winding wire 11 around the body 12 and welding the winding wire 11 thereon; wherein the body 12 is formed with two primary-side welding protrusions (124*a*,125*a*), a primary-side center-tapped protrusion 123*a*, two secondary-side welding protrusions (124*b*,125*b*), and a secondary-side center-tapped protrusion 123*b*.

Figure 7:
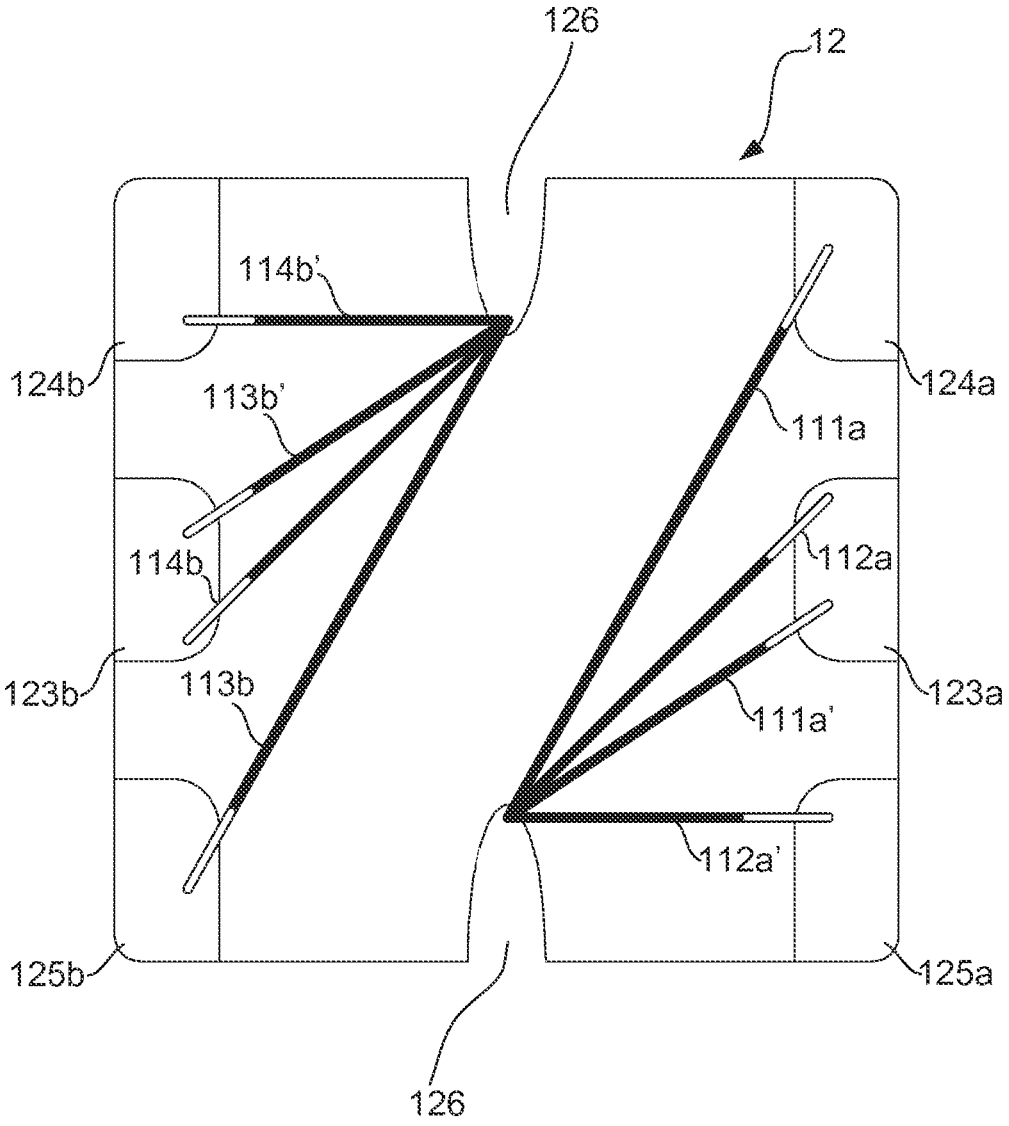
FIG. 7 is a schematic diagram of welding point.
Figure 8:
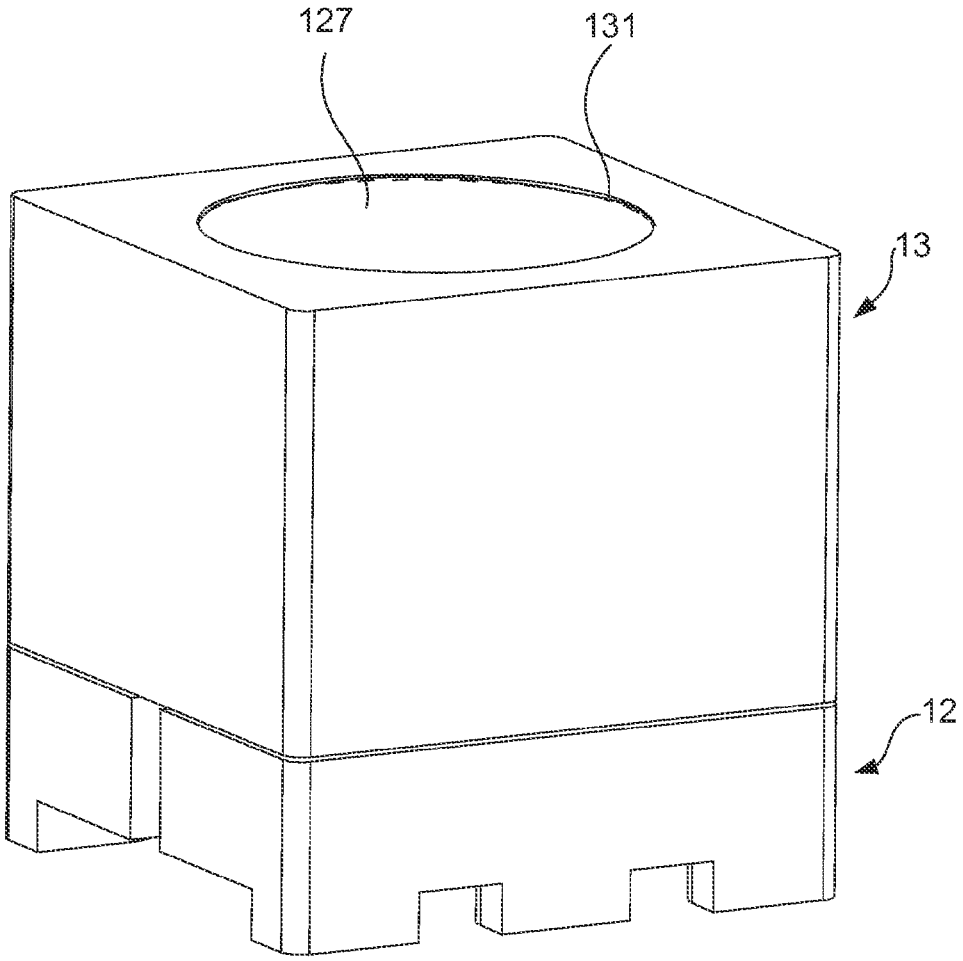
FIG. 8 is a stereo view of the inductor of second embodiment.
Figure 9:
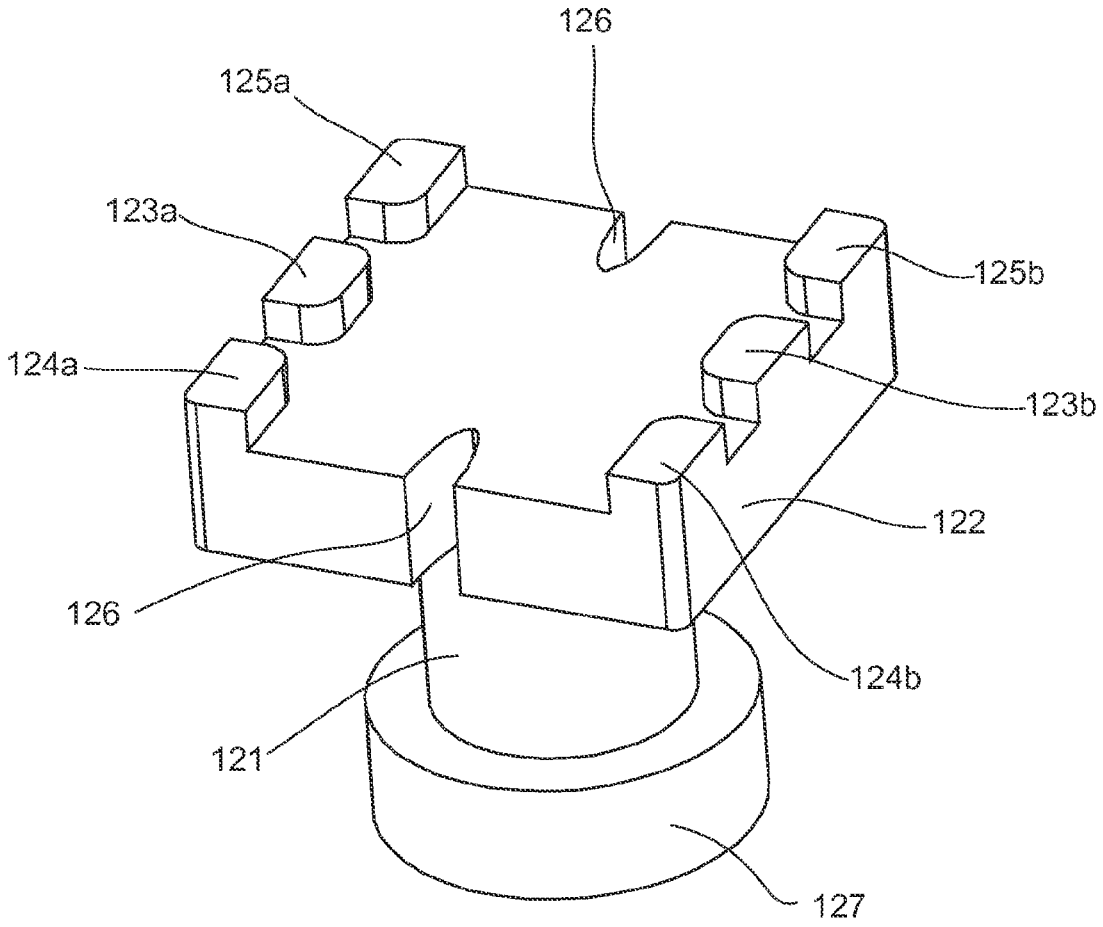
FIG. 9 is a stereo view of body.
Figure 10:
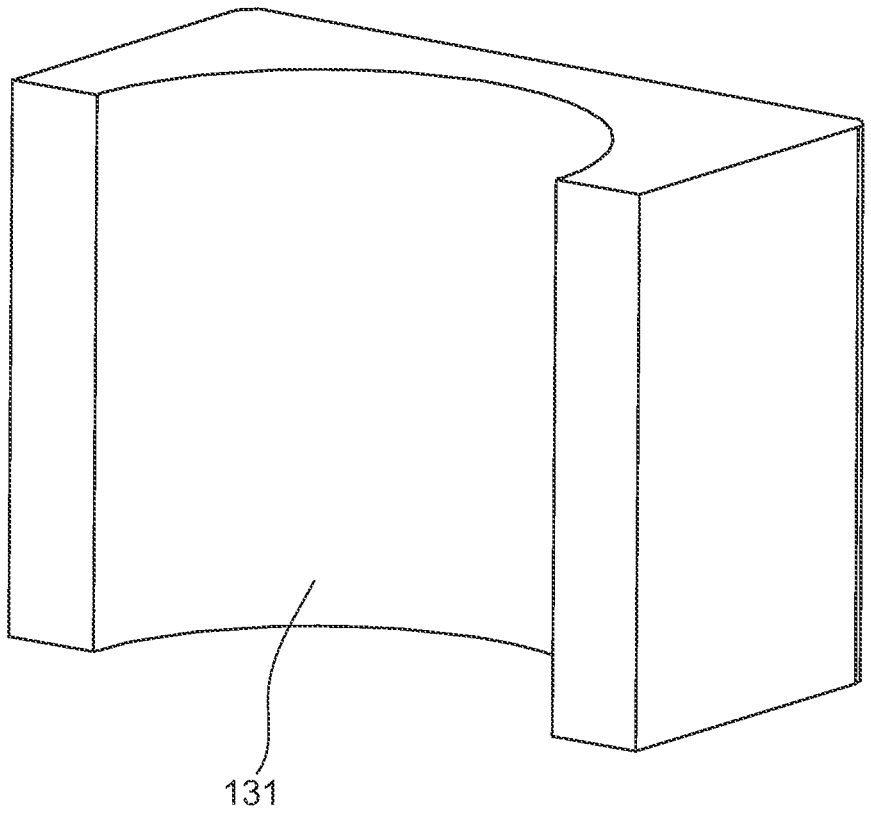
FIG. 10 is a sectional side view of housing.
Figure 11A:
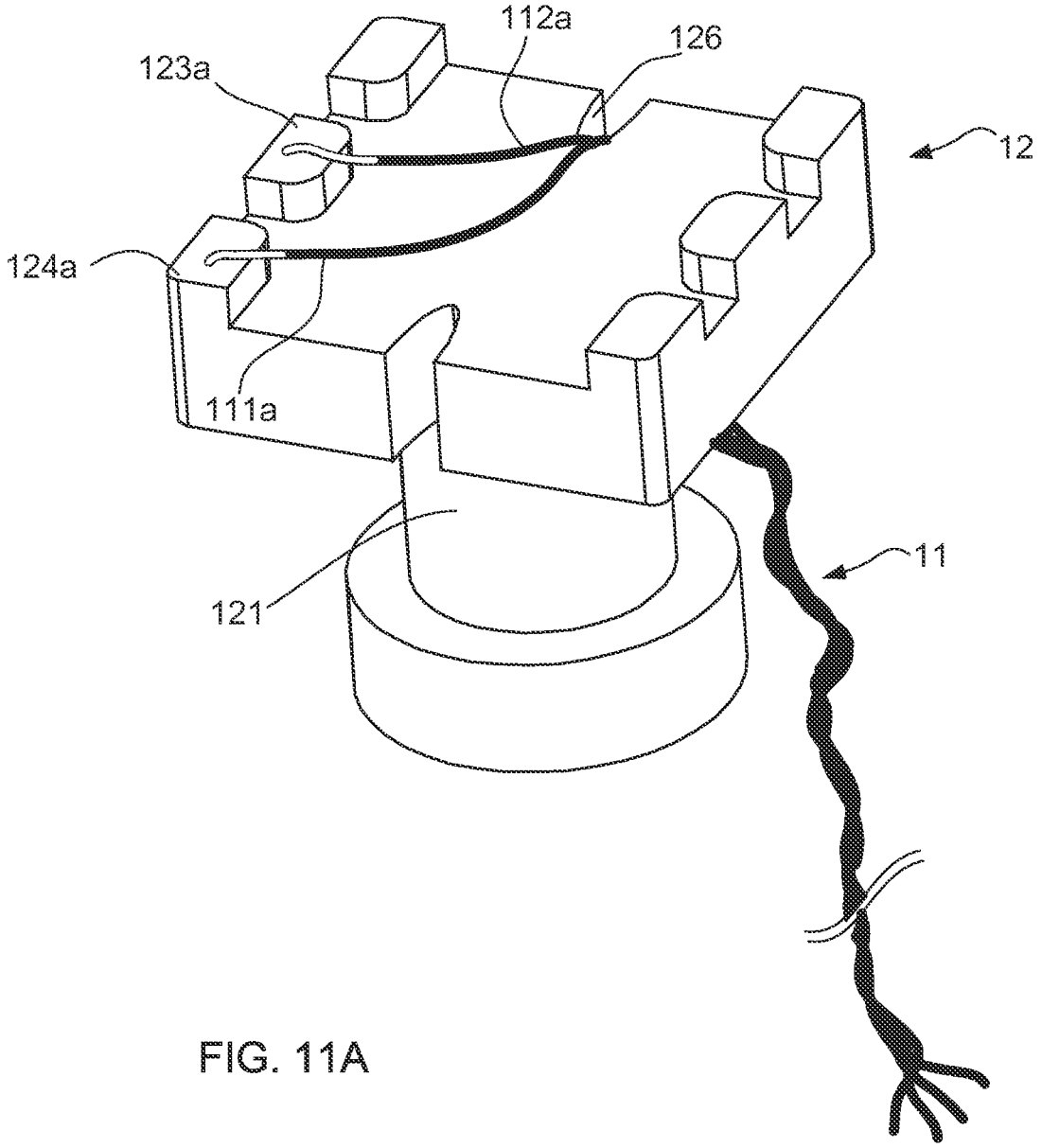
FIG. 11A to FIG. 11D is a motion diagram of wire winded around body.
Figure 11B:
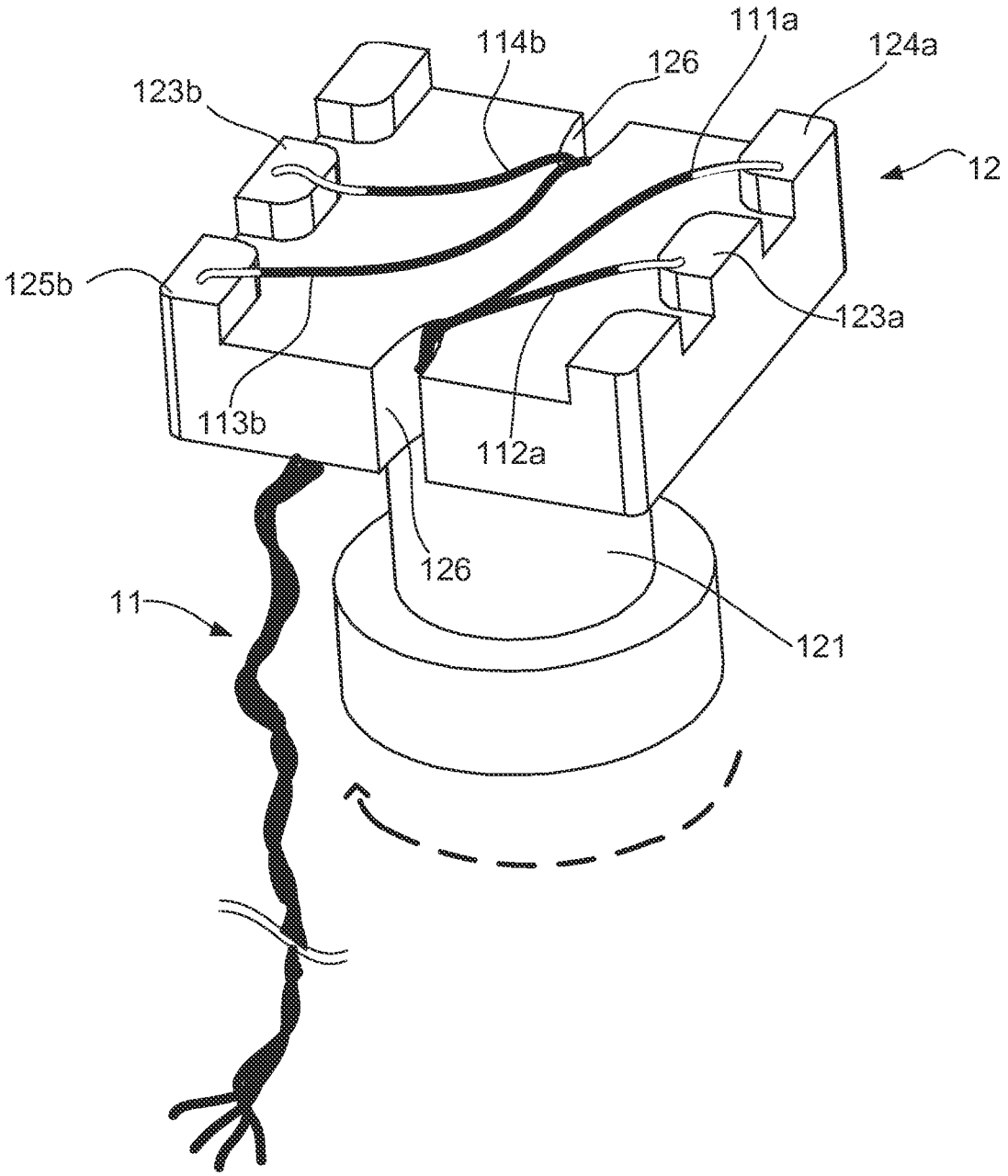
Figure 11C:
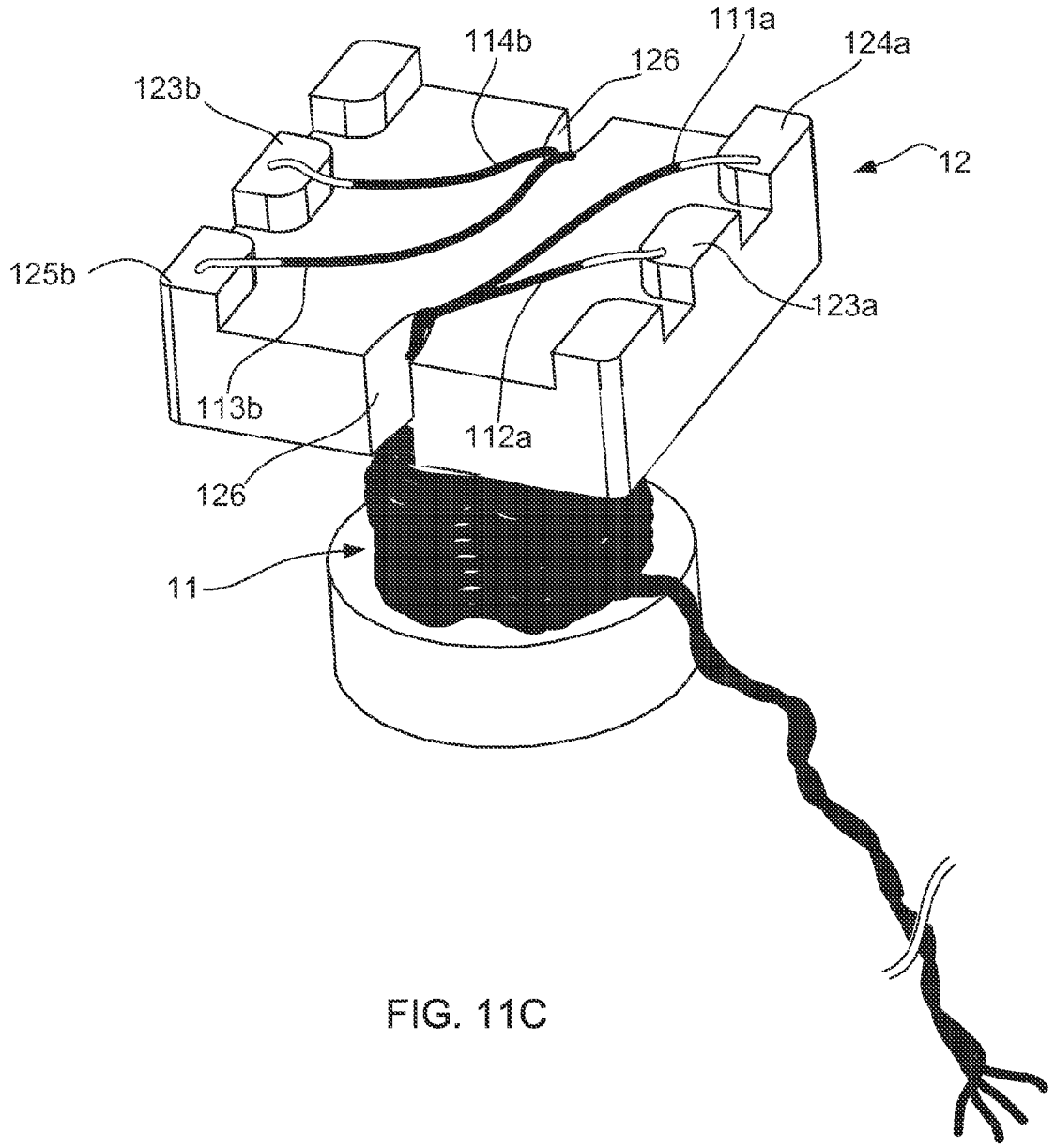
Figure 11D:
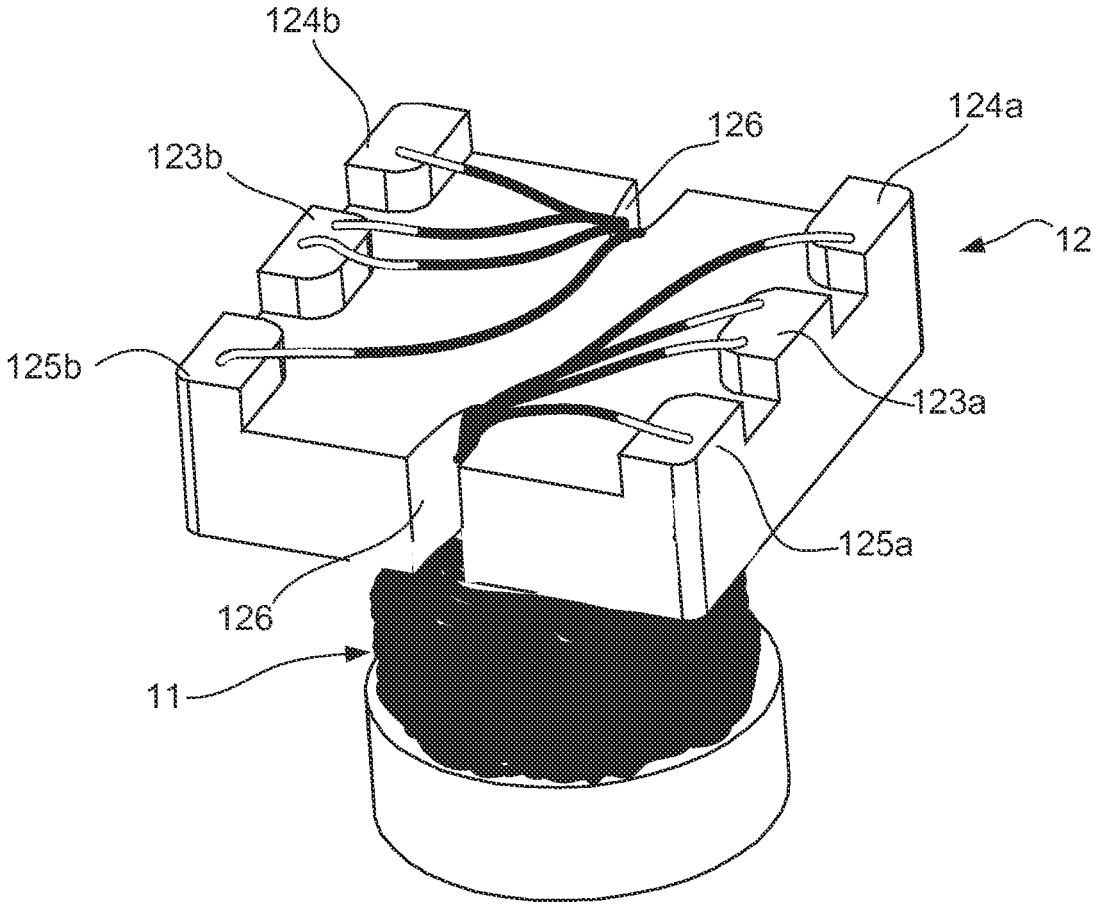
Figure 12:
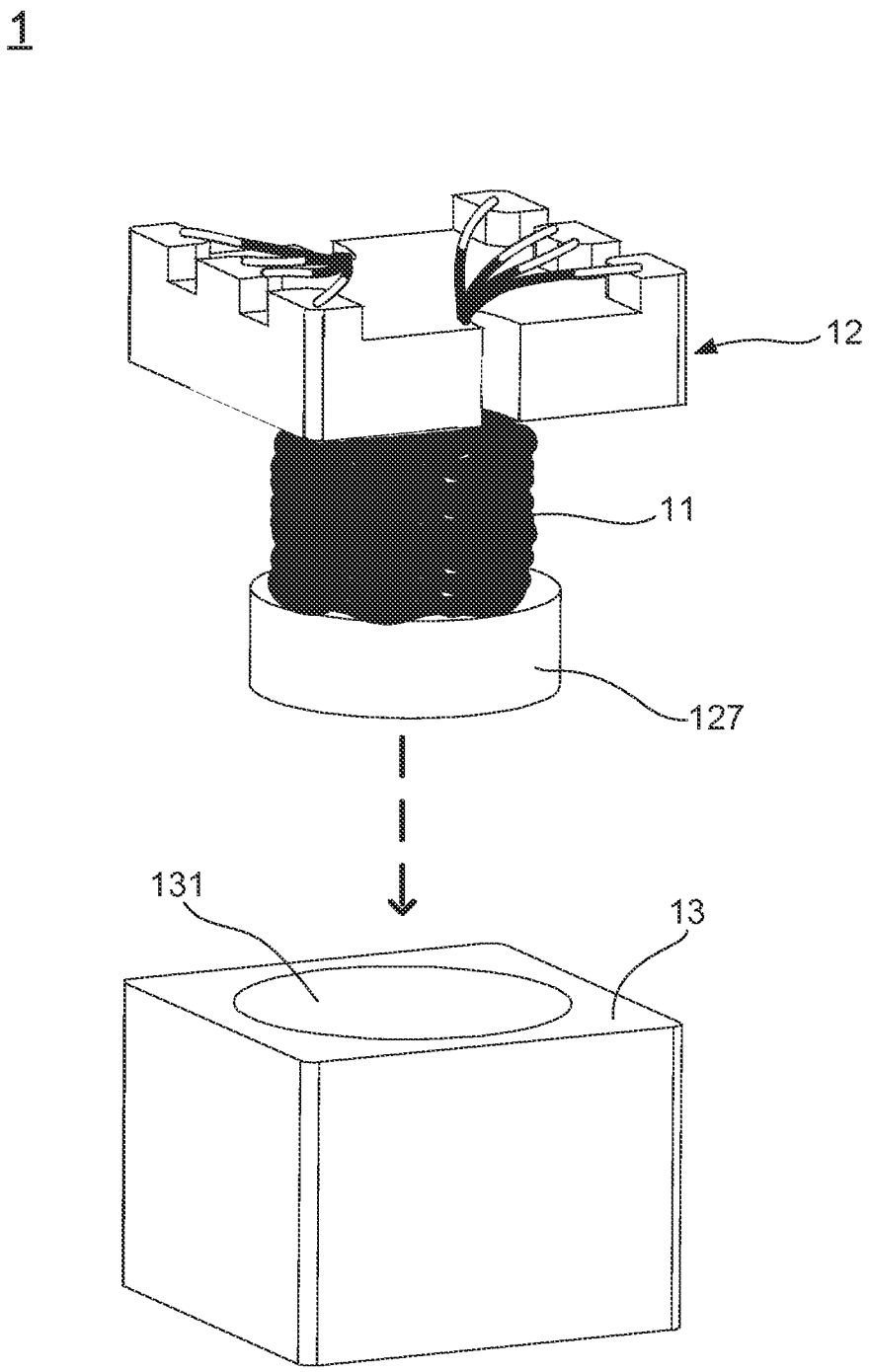
FIG. 12 is a schematic assembly diagram of inductor.

With reference to FIG. 7, according to the technique of the present invention, one end of the at least two primary-side wires (111,112) are respectively welded on the two primary-side welding protrusions (124*a*,125*a*), and the other end of the two primary-side wires (111,112) being welded on the primary-side center-tapped protrusion 123*a*; moreover, one end of the at least two secondary-side wires (113,114) are respectively welded on the two secondary-side welding protrusions (124*b*,125*b*), and the other end of the two secondary-side wires (113,114) are welded on the secondary-side center-tapped protrusion 123*b*.

Additionally, the body 12 further comprises two wire locating slots 126 formed between the primary-side (primary-side welding protrusions and primary-side center-tapped protrusion) and the secondary-side (secondary-side welding protrusions and secondary-side center-tapped protrusion) of the body 12; wherein the primary-side wires (111,112) and the secondary-side wires (113,114) are respectively located and welded on welding portion 122 via the wire locating slots 126.

However, there also can be merely one wire locating slot formed on the body 12 in other embodiments, and the primary-side wires and secondary-side wires located and welded on the welding portion through the said wire locating slot, so as to simplify the structure of the inductor.

Figure 4:
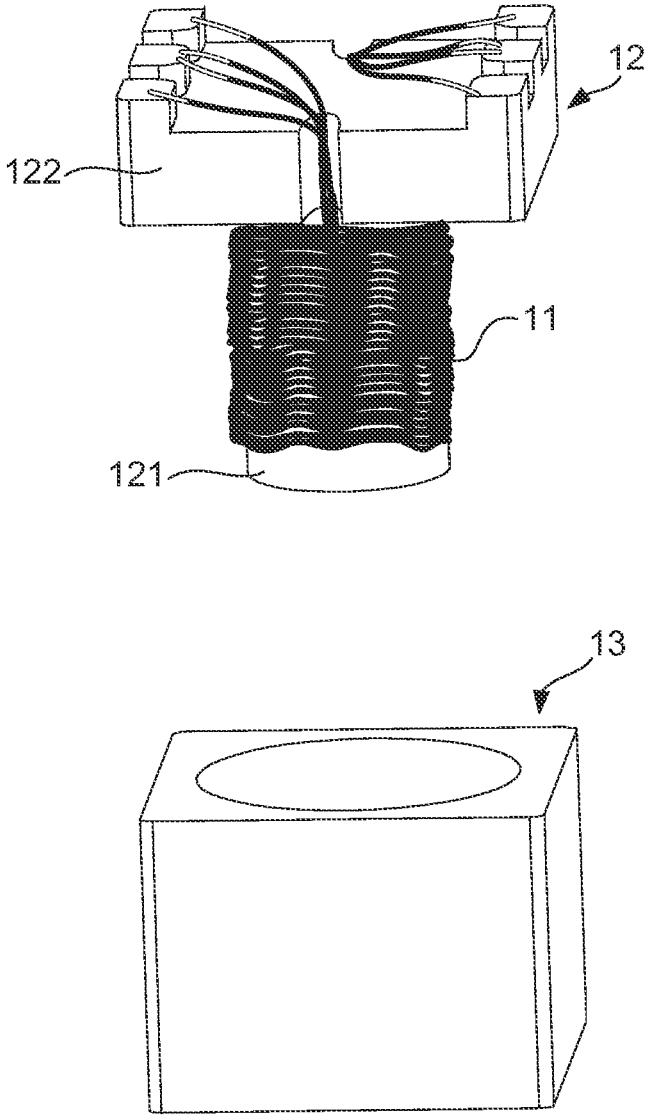
FIG. 4 is a schematic assembly diagram of an inductor of the present invention.
Figure 5:
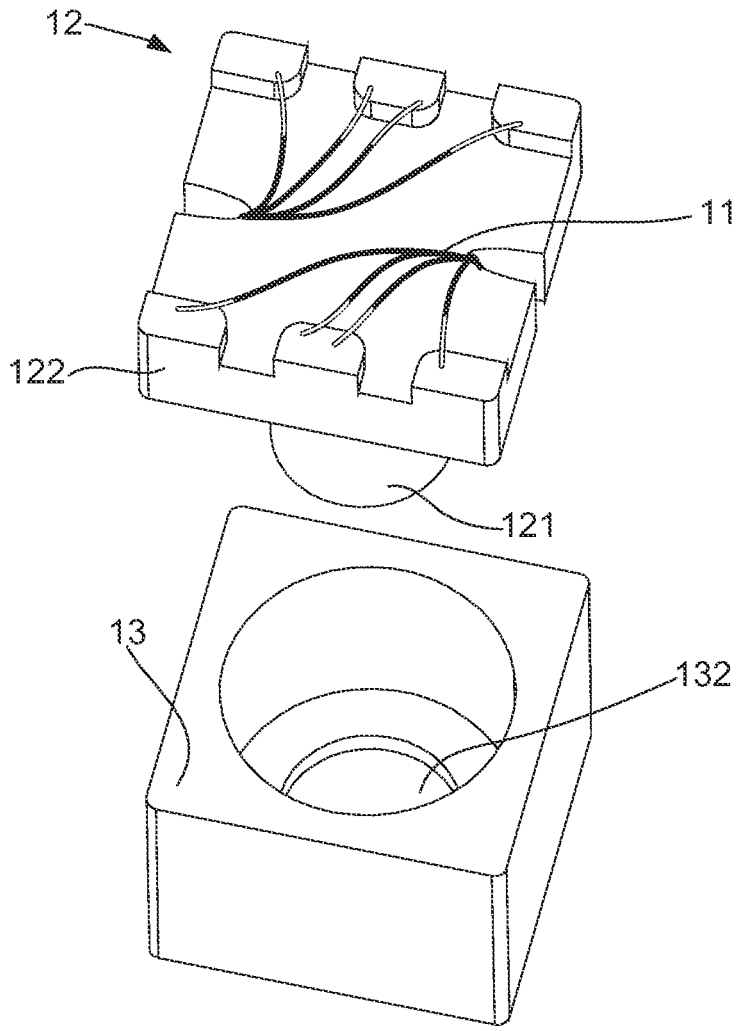
FIG. 5 is a second schematic assembly diagram of the inductor.
Figure 6:
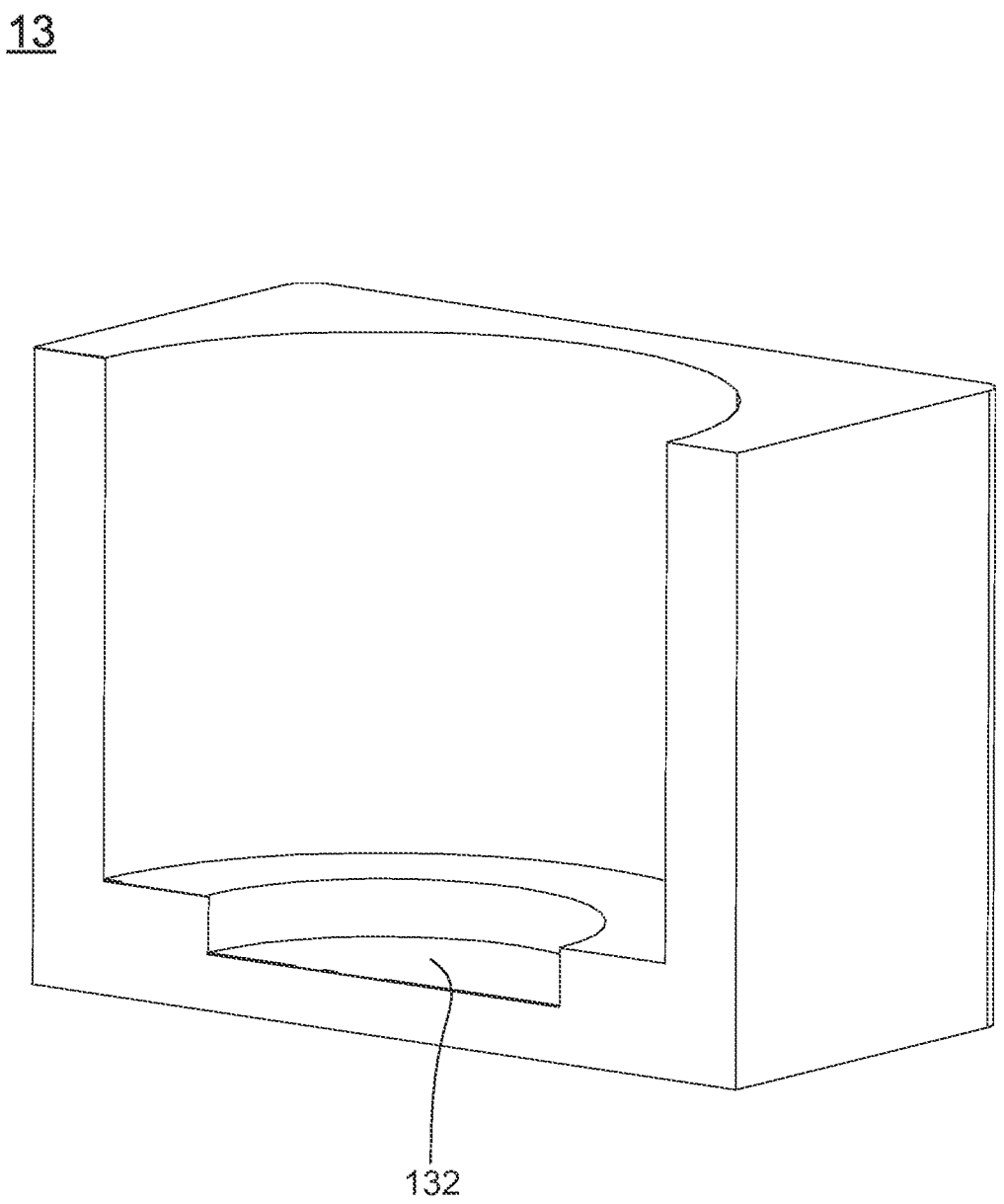
FIG. 6 is a sectional side view of housing.

Finally, during the housing covering step, the housing 13 covers the body 12, wherein refer to FIG. 3, FIG. 4, and FIG. 6, the body 12 comprises the welding portion 122 and the winding portion 121, moreover, the primary-side welding protrusions (124*a*,125*a*), the primary-side center-tapped protrusion 123*a*, the secondary-side welding protrusions (124*b*,125*b*), and the secondary-side center-tapped protrusion 123*b* being formed on the welding portion 122, and the winding wire 11 being winded around the winding portion 121.

Please refer to FIG. 8, FIG. 9, FIG. 10, FIG. 11A to 11D, and FIG. 12, there are respectively shown a stereo view of the inductor of second embodiment, a stereo view of body, a sectional side view of housing, a motion diagram of wire winded around body, and a schematic assembly diagram of inductor. As the FIGs shown, the inductor of the present invention also includes a second embodiment, and according to the second embodiment, the body 12 of the inductor 1 further comprises a blocking portion 127 formed on the lower end of the winding portion 121; moreover, the housing 13 is provided with an accommodating hole 131 for being corresponded to the blocking portion 127; therefore, when the housing 13 covers the body 12, the winding portion 121 is housed by the housing 13 and the blocking portion 127 is exposed out of the housing 13 via the accommodating hole 131.

Furthermore, with reference to FIG. 11A to FIG. 11D, during the winding wire 11 winds around the body 12, first of all, respectively weld one end (111*a*, 112*a*) of the at least two primary-side wires (111, 112) on the primary-side welding protrusion 124*a* and the primary-side center-tapped protrusion 123*a* via one of the wire locating slots 126; afterward, half turn the body 12 for facilitating one end (113*b*, 114*b*) of the at least two secondary-side wires (113, 114) respectively weld on the secondary-side welding protrusion 125*b* and the secondary-side center-tapped protrusion 123*b* through the other wire locating slots 126.

Then, spin the body 12 for winding the winding wire 11 around the body 12 from start to end and continually winding back to the top of the body 12. Finally, respectively weld the other end (112*a*', 111*a*') of the at least two primary-side wires (111, 112) on the primary-side welding protrusion 125*a* and the primary-side center-tapped protrusion 123*a* via one of the wire locating slots 126; meanwhile, respectively weld the other end (114*b*', 113*b*') of the at least two secondary-side wires (114, 113) on the secondary-side welding protrusion 124*b* and the secondary-side center-tapped protrusion 123*b* via the other wire locating slots 126.

Through above descriptions, the constituting elements of the related technology features of the inductor of the present invention have been clearly and completely introduced; in summary, the present invention has the following advantages:

1. Through the twisting of the wires facilitates the size of inductor can be remained when the length of the winding wire is increasing.

2 Inheriting to advantage above, through the twisting of the wires make the structure of the inductor change, so as to decrease the volume of the inductor and replace the conventional inductor.

3. Through the center-tapped protrusions and the welding protrusions make the inductor merely have six output terminals, therefore, PCB board just need six pins for connecting the inductor.

4. Through the production method of the present invention, not only greatly reduce the volume of inductor, but also simplify the production process thereof so as to reduce the manufacturing cost of inductors.

The above description is made on embodiments of the present invention. However, the embodiments are not intended to limit scope of the present invention, and all equivalent implementations or alterations within the spirit of the present invention still fall within the scope of the present invention.

What is claimed is:

1. An inductor, comprising:

a body;

a winding wire, being winded around the body, wherein the winding wire comprises at least two primary-side wires and at least two secondary-side wires;

a housing, being used for covering the body;

wherein the body is formed with two primary-side welding protrusions, a primary-side center-tapped protrusion, two secondary-side welding protrusions, and a secondary-side center-tapped protrusion;

wherein one end of the at least two primary-side wires are respectively welded on the two primary-side welding protrusions, and the other end of the two primary-side wires being welded on the primary-side center-tapped protrusion;

wherein the body further comprises a welding portion and a winding portion, and the primary-side welding protrusions, the primary-side center-tapped protrusion, the secondary-side welding protrusions, and the secondary-side center-tapped protrusion being formed on the welding portion, and the winding wire being winded around the winding portion;

wherein a recess is formed in inner bottom of the housing, and when the housing covers the body, the winding portion is housed by the housing and the lower end of the winding portion is disposed in the recess;

wherein one end of the at least two secondary-side wires are respectively welded on the two secondary-side welding protrusions, and the other end of the two secondary-side wires are welded on the secondary-side center-tapped protrusion.

2. The inductor of claim 1, wherein the body further comprises a blocking portion formed on the lower end of the winding portion.

3. The inductor of claim 2, wherein the housing is provided with an accommodating hole for being corresponded to the blocking portion; therefore, when the housing covers the body, the winding portion is housed by the housing and the blocking portion is exposed out of the housing via the accommodating hole.

4. The inductor of claim 1, wherein the body and the housing are made of a plastic doped with iron powder.

5. The inductor of claim 1, wherein the said primary-side wires and the said secondary-side wires consist of a copper wire and an insulating layer enclosing the copper wire.

* * * * *